US005105641A

United States Patent [19]

Veit

[11] Patent Number: 5,105,641

[45] Date of Patent: Apr. 21, 1992

[54] APPARATUS FOR FORMING WIRE

[75] Inventor: Gustav Veit, Reutlingen-Sondelfingen, Fed. Rep. of Germany

[73] Assignee: WAFIOS Maschinenfabrik GmbH & Co. Kommanditgesellschaft, Fed. Rep. of Germany

[21] Appl. No.: 503,906

[22] Filed: Apr. 4, 1990

[30] Foreign Application Priority Data

May 13, 1989 [DE] Fed. Rep. of Germany ..... 3915784

[51] Int. Cl.[5] ..... B21F 35/02

[52] U.S. Cl. ..... 72/137; 140/102; 72/140

[58] Field of Search ..... 72/135, 137, 140; 140/71 R, 102, 103

[56] References Cited

U.S. PATENT DOCUMENTS

| | | | |
|---|---|---|---|
| 2,101,982 | 12/1937 | Carlberg . | |
| 2,134,469 | 10/1938 | Bergevin | 72/137 X |
| 3,983,732 | 10/1976 | Noyce | 72/137 X |
| 4,296,621 | 10/1981 | Ohdai et al. | 72/137 X |
| 4,416,135 | 11/1983 | Russell . | |
| 4,485,851 | 12/1984 | Takumi | 72/137 X |
| 4,503,694 | 3/1985 | Takumi | 72/137 X |
| 4,555,924 | 12/1985 | Remy et al. | 72/307 |
| 4,680,950 | 7/1987 | Ohdai et al. | 72/137 X |
| 4,893,491 | 1/1990 | Ohdai et al. | 72/137 |
| 4,947,670 | 8/1989 | Wu . | |

FOREIGN PATENT DOCUMENTS

| | | | |
|---|---|---|---|
| 1293121 | 4/1969 | Fed. Rep. of Germany . | |
| 2843444 | 4/1979 | Fed. Rep. of Germany . | |
| 63-52724 | 3/1988 | Japan . | |
| 492580 | 9/1938 | United Kingdom | 72/137 |

*Primary Examiner*—Lowell A. Larson
*Assistant Examiner*—Michael J. McKeon
*Attorney, Agent, or Firm*—Wigman & Cohen

[57] ABSTRACT

This invention relates to an apparatus for the forming of wire, namely a leg or spiral spring winding and bending machine.

It is an object of the present invention to reduce the expenditure for the production of the apparatus and to universalize the forming operations which can be carried out with each tool.

The apparatus including a plurality of tools (86, 88, 90, 92 or 142; 162, 190, 192) on a tool holder (74; 160) which is fixed at the free end of a longitudinally displaceable shaft (12) resembling the known winding spindle and is replaceable. Every existing tool can be brought into the pathway of the wire and hence into operation by positioning the shaft by rotation and longitudinal displacement by means of a drive which is known from the conventional winding spindle but differently controlled.

The advantage of this apparatus is that it is of simplified construction and enables the same tools to be used for producing different forms of springs.

8 Claims, 10 Drawing Sheets

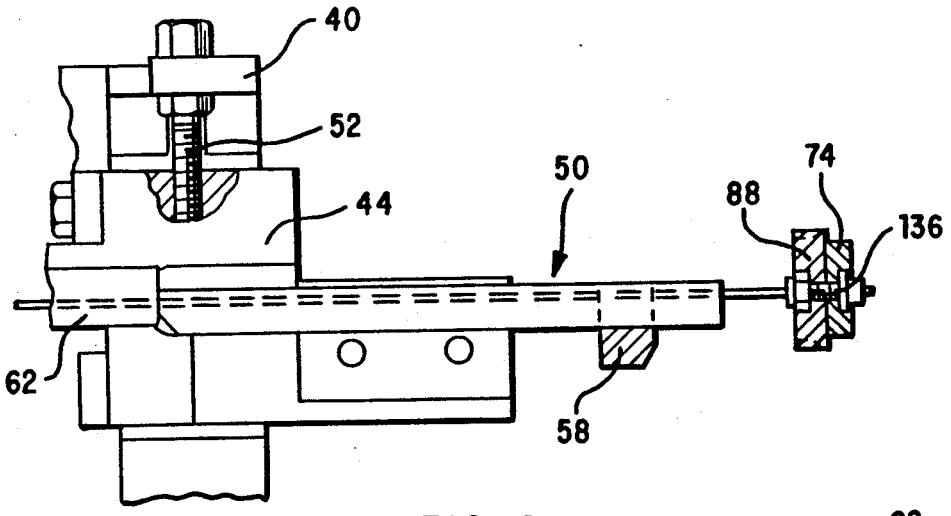
FIG. 2
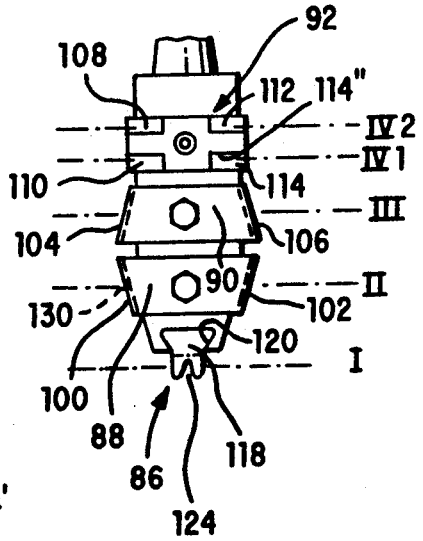
FIG. 3
FIG. 7
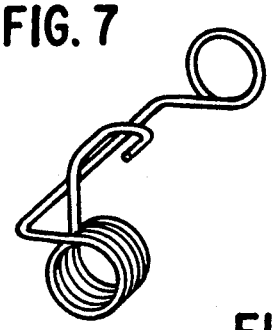
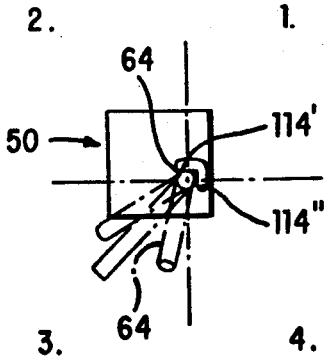
FIG. 5
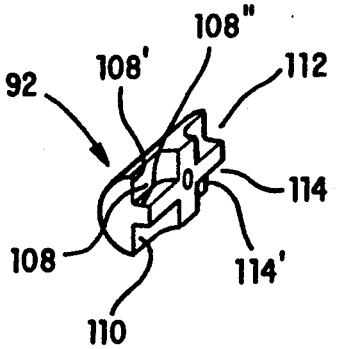
FIG. 4

APPARATUS FOR FORMING WIRE

BACKGROUND OF THE INVENTION

This invention relates to an apparatus for the forming of wire by winding and/or bending, in particular for the production of torsion springs, tension springs, tension springs bent at each end to form eyelet shanks and bending parts. e.g. with curved sections of any radii of curvature, comprising a continuously or selectively, intermittently operating wire feed device arranged at the inlet end, a wire guide and controlled tools arranged at the outlet end of the wire guide and movable in a selective sequence transversely and optionally longitudinally to the wire leaving the wire guide.

Apparatus of the type mentioned above are already known (DE-PS 1 293 121 and DE-OS 28 43 444). In the apparatus according to DE-PS 1 293 121, four tools are provided, each at the free end of a rocking lever, and arranged round the wire guide and in the vicinity thereof. In one operating cycle, the wire deflecting tools are brought into contact with the continuously forwardly moving wire by successive operation of the rocking levers for completely forming one workpiece. By deflecting the rocking levers to a greater or less extent, i.e. by placing the workpieces at a greater or lesser distance from the mouth of the wire guide by adjusting the stroke of an associated cam drive, it is possible to form the forwardly fed wire into curved sections of widely differing radii of curvature as well as wire coils.

The design of the four rocking levers with their adjustable and displaceable workpiece holders and their control cams and adjustable and displaceable transmission members for performing the rocking movements which must be correctly adapted in time and pathway to the workpiece to be produced requires an apparatus which is expensive and mechanically difficult to manufacture.

In the spring winding machine disclosed in DE-OS 28 43 444 used for example, for the manufacture of a spiral spring with hooks at each end, comprising a wire guide having an intermittently operating wire feed device provided in front of its inlet end. four or more tool units are arranged radially around the wire guide and in the vicinity thereof. These tool units are controlled by a central wheel, each by way of a pinion, a cam disc and a cam roller to execute a radial movement against the wire leaving the wire guide. This means that the tools can only be moved in this radial direction towards or away from the wire guide to shape the wire which is being fed forwards. Although this spring winding machine is simpler in construction than the apparatus according to DE-PS 1 293 121, it is not universal in its application.

OBJECTS AND SUMMARY OF THE INVENTION

It is an object of the present invention substantially to simplify the mechanical construction of an apparatus for forming wire. It is also intended that the forming operations required (winding and/or bending and optionally eyelet formation) should as far as possible be universally applicable.

To solve this problem according to the invention, the tools for forming wire by winding and/or bending are arranged in a rotatable and displaceable head which is replaceably mounted in the lower end of a winding spindle, e.g. a commercially available CNC-controlled bent spiral spring winding machine. By employing this arrangement, the bending and winding operations can be carried out directly at the nozzle of a special wire guide.

Preferably, up to eight tools are fixed in the rotatable and displaceable head in two or more planes situated one above the other. In one of these planes, an additional device, e.g. an eyelet forming device may be arranged on this head. By virtue of the CNC-controllable freely selectable, reversible longitudinal and rotary displacement of the winding spindle, the various tools can be brought into their exact operative position for forming the wire in a selective sequence from above downwards or conversely, from the right or from the left or in a superimposed movement. Forming of the workpieces is brought about entirely by this multiflexible bending and winding centre.

The invention can be carried out in conventional spiral spring winding and bending machines by converting the winding spindle into a rotatable and displaceable shaft of the tool head by altering the drive to the spindle so that it executes not only controlled movements of rotation but also controlled movements of axial displacement while the wire feed device can be retained.

BRIEF DESCRIPTION OF THE DRAWINGS

The invention will now be described in detail with reference to a preferred embodiment of the machine according to the invention illustrated by way of example (in part schematically) in the drawings, in which FIG. 2 is a top plan view of the lower part of the first embodiment, also partially in section, FIG. 3 is a side view of a section of FIG. 1, FIG. 4 is a view in perspective of a tool of the first embodiment, FIG. 5 is a side view of the wire guide of the first embodiment shown in FIG. 1, FIG. 7 shows a wire workpiece produced by means of the first embodiment.

DETAILED DESCRIPTION OF PREFERRED EMBODIMENTS

First embodiment

Figure 1:
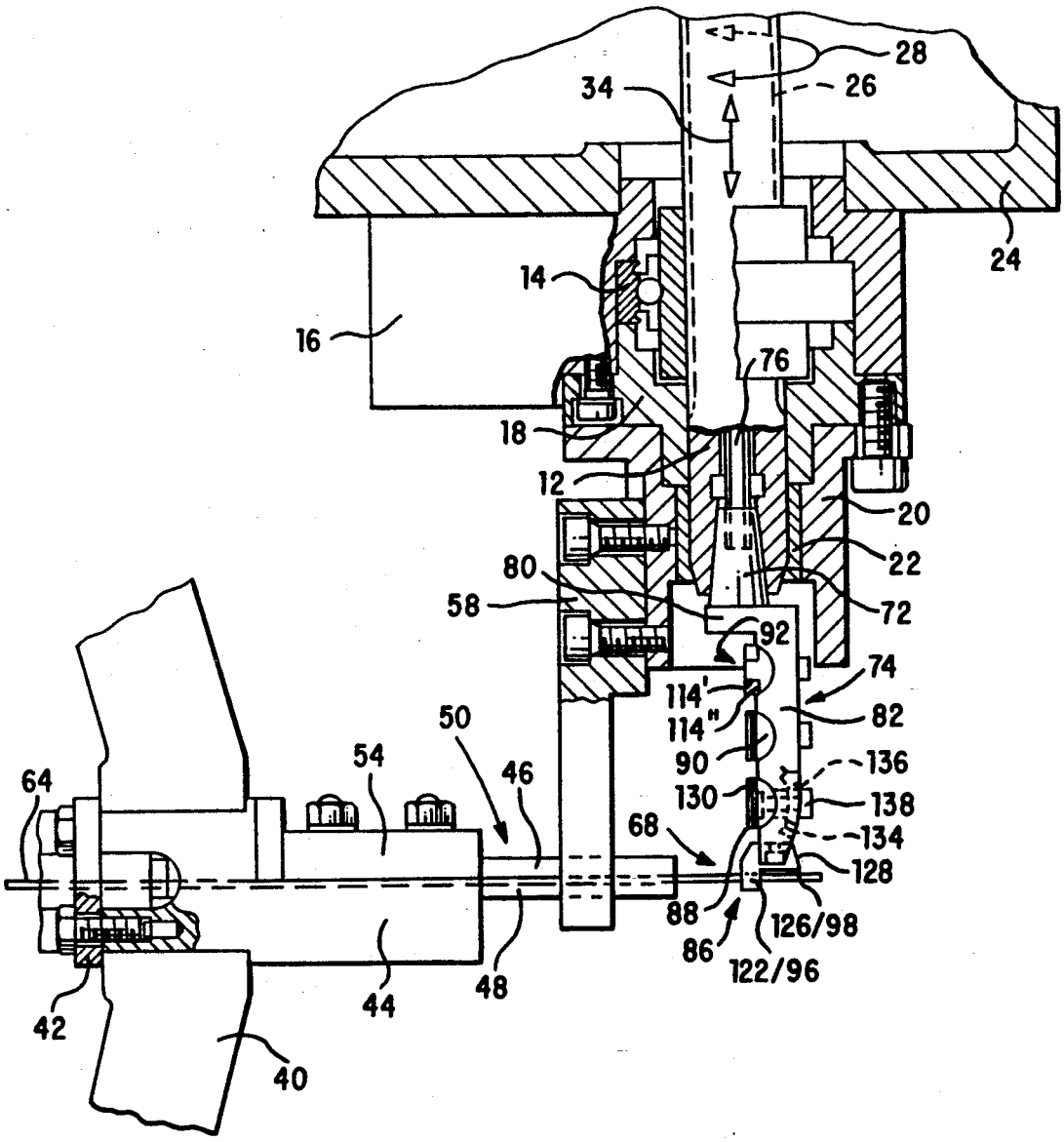
FIG. 1 is a front view of a first embodiment, partially broken off and in section.
Figure 8A:
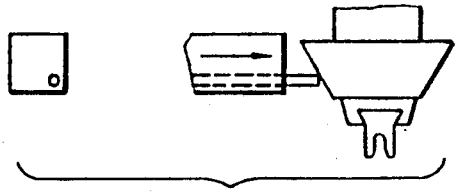
FIG. 8 shows the various stages in the manufacture of the workpiece of FIG. 7, each part (a to o) of the FIG. showing, on the righthand side, a front view of the wire guide of the first embodiment with rotatable and displaceable head and, on the lefthand side the wire guide in side view.
Figure 8B:
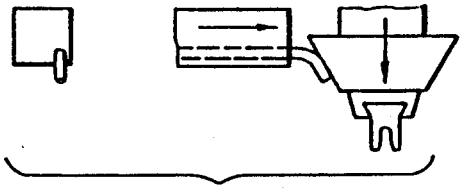
Figure 8C:
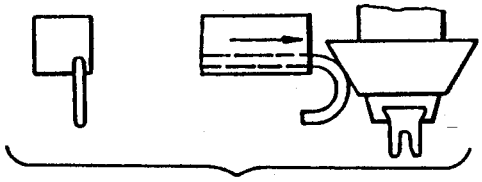
Figure 8D:
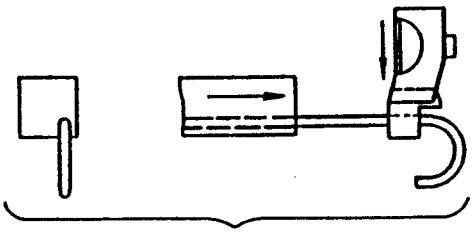
Figure 8E:
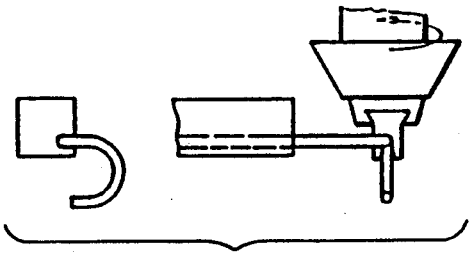
Figure 8F:
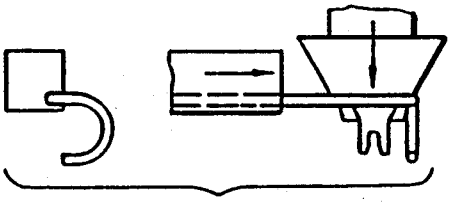
Figure 8G:
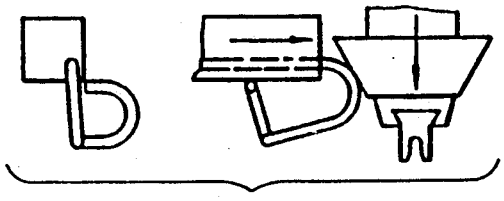
Figure 8H:
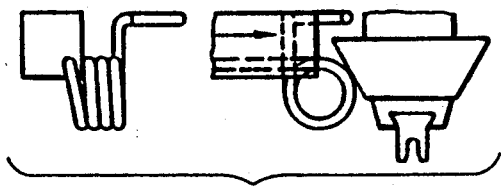
Figure 8I:
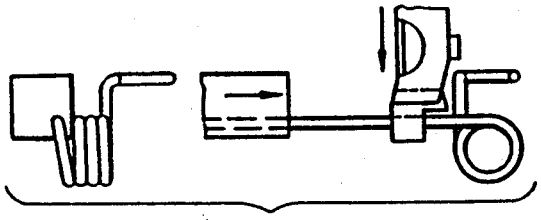
Figure 8J:
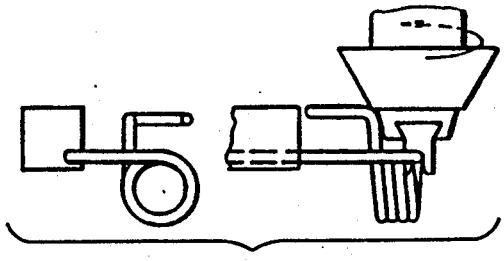
Figure 8K:
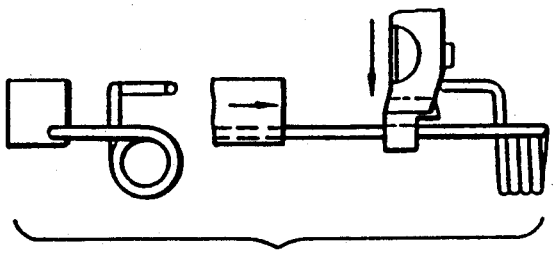
Figure 8L:
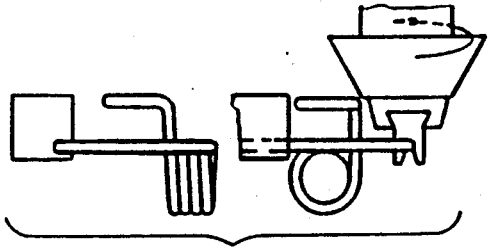
Figure 8M:
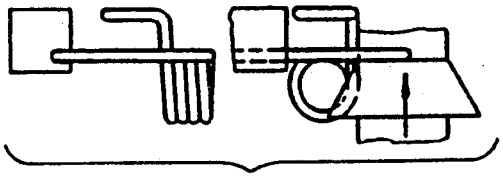
Figure 8N:
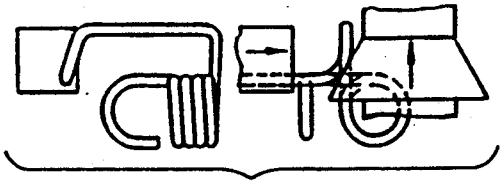
Figure 8O:
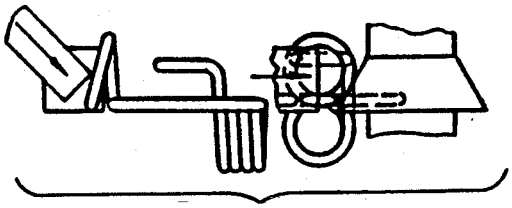

In FIG. 1 an upper part of a winding spindle (12) is rotatably mounted in a self-aligning ball bearing (14) situated between two flanged bearings (16, 18) while the lower part of the winding spindle (12) is supported in an additional flanged bearing (20) with journal bearing bush (22). All three flanged bearings (16, 18, 20) are rigidly connected to a socket (24) for the winding spindle. The winding spindle (12), which is toothed (26) on its circumference over a great part of its length, is driven by an adjustable servo motor (28) by way of a toothed belt drive (not shown)and a pinion (also not shown), the extent of rotation of the winding spindle, the sense of rotation and the point of standstill being freely selectable.

To enable the winding spindle (12) to execute a longitudinal displacement in addition to its rotation, optionally simultaneously with said rotation, another adjustable servo motor (34) is provided to drive a known ball screw transmission by way of a toothed belt transmission to convert the rotation of the servo motor into a longitudinal movement for the winding spindle (12). This longitudinal movement takes place by way of further transmission members. All these parts are known and therefore not illustrated here. For this longitudinal movement, the diameter of the bore of the self-aligning ball bearing (14) has a sliding fit. The magnitude of the longitudinal movement of the winding spindle (12) can also be freely selected by CNC control.

As shown in FIGS. 1 and 2, a holder (44) for a divided special wire guide (50) comprising an upper part (46) and a lower part (48) and designed to be adjusted to the workpiece to be formed is clamped in a bearing block (40) (merely indicated) to the left of the winding spindle (12) by means of a clamping lid (42). This holder (44) can be displaced transversely to its longitudinal axis by means of an adjusting screw (52) so that it can be adjusted in relation to forming grooves on the forming tools in tool holders (74,160). The wire guide (50) is held in the holder (44) by means of a lid (54).

The bearing block (40) can be displaced in the direction of the winding spindle (12) to adapt the length of the wire guide to the wire workpiece which is to be formed. The flanged bearing (20) is provided with a support (58) for the wire guide (50) projecting from the holder (44). Adjoining the wire guide (50) is another wire guide (62) extending to the wire intake rollers (not shown). The wire intake rollers are driven by another adjustable servo motor by way of a toothed belt transmission so that an endless wire (64) controlled by CNC control, can be moved forwards intermittently in a horizontal straight line through the guide channels of the wire guides (62,50) into the bending and winding centre (68) in front of the winding spindle (12).

A conical holder is provided at the lower end of the winding spindle (12) to receive the cone (72) of a tool holder (74), the so-called rotating and displacement head, this conical holder being held in position by means of a screw (76) extending through the winding spindle (12) from above. The cone (72) is followed by a rectangular part (80) of the tool holder (74). This tool holder is cut away in the longitudinal direction be over half its width for the greatest part of its length. The recess thereby formed is necessary to enable the wire workpiece to move freely during the forming process.

The remaining part (82) of the tool holder (74) has four shaping tools (86,88,90,92) with a total of ten operating zones (96,98, 100, 102, 104, 106, 108, 110, 112, 114) arranged above one another in four different planes I to IV.

The tool (86) in plane (I) is a bending tool and has its prismatic part (118) fixed in a prism guide (120) of the tool holder (74) by means of a screw. The bending tool (86) has a projection (122) on its left side in which a guiding or operating groove (124) is formed. Oblique channels are provided to enable the tool (86) to be firmly pushed over the wire (64). The said operating groove (124) is used for forming the bends on the straight arms, e.g. of the workpiece shown in FIG. 4.

The prismatic part (118) of the bending tool (86) is provided with another bending edge (126) for downwardly directed bends which are produced when the bending tool (86) moves downwards after it has been brought into the bending position by rotation of the winding spindle (12) through 180°. Since the bending edge (126) is followed by an upwardly directed surface (128) inclined towards the tool holder (74), a bending angle greater than 90°. in other words over bending, can be obtained by an additional brief supply of wire after the bending process.

In plane (II), the winding tool (88) has its cross-sectional profile which is semicircular in the longitudinal direction, fixed in a suitable receiver of the tool holder (74) by means of a screw. The winding tool (88) has two lateral, downwardly directed oblique end faces (100,102) each of which has (at least) one guide groove (130) for the wire (64) moving up into it. To enable the groove (130) to be adapted to the direction of winding of the spring body to be produced, a recess with rounded base (134) is cut into the tool holder (74). The winding tool (88) is fixed by a screw (138) with the aid of a disc (136) which has a concavity of suitable radius on one side. The winding tool (88) can thereby be deflected upwards or downwards by a few angular degrees.

When the tool holder (74) is moved downwards by the spindle (12) so that the tool (88) in plane (II) comes to lie in the operative position in front of the wire guide (50) and the spindle has been rotated anti-clockwise by 90°, the operating zone (100) of the winding tool (88) comes into play. The wire (64) moving up into this zone is then formed into a downwardly spiralling spring body with lefthanded turns projecting out of the plane of the drawing. After further rotation through 180° from this position the operating zone (102) comes into play. A downwardly spirally spring body with righthand turns extending into the plane of the drawing is now formed. When the upwardly directed operating zone (104) of the winding tool (90) in plane (III) is in operation, an upwardly spiralling spring body with righthand turns projecting from the plane of the drawing is formed and when the operating zone (106) of the winding tool (90) is in operation a spring body with lefthand turns extending into the plane of the drawing is formed.

By displacing upwards or downwards the point at which the wire (64) leaving the mouth of the wire guide (50) encounters the operating zones (100 to 106) of the winding tools (88,90) of the planes (II) or (III), it is possible to produce smaller or larger winding diameters within the region of the operating zones. This displacement may be carried out before or during the winding process. For producing a spring body comprising sections of different winding pitches, the winding spindle (12) is turned clockwise or anticlockwise during the winding process according to the measure of the pitch, whereby the wire moving into contact with the operating zone is deflected by the grooves (130). Spring bodies with a bias tension can be produced by a displacement against the direction of the pitch.

The additional bending tool (92), which has two operating planes (IV 1) and (IV 2) as shown in the perspective view in FIG. 4, is fixed in the plane (IV). The bending tool (92) comprises four operating zones (108, 110, 112, 114), each with two bending edges, e.g. (108'; 108") or (114'; 114").

FIG. 5 shows which operating zone of which of four three-dimensional quadrants can come into play for carrying out the various bending operations. Thus, the bending edges (114',114") of the operating zone (114) are responsible for carrying out all the forwardly or backwardly, upwardly or downwardly directed three-dimensional bending operations situated in the third quadrant and produced by longitudinal movements superimposed on movements of rotation of the winding spindle(12). Operating zone (!08) carries out all the bending operations in the first quadrant, operating zone (112) all the bending operations in the second quadrant and operating zone (110) all the bending operations in the fourth quadrant, in each case by appropriate movements of the winding spindle after the respective operating zones have been brought into the operating position by the winding spindle.

Figure 6:
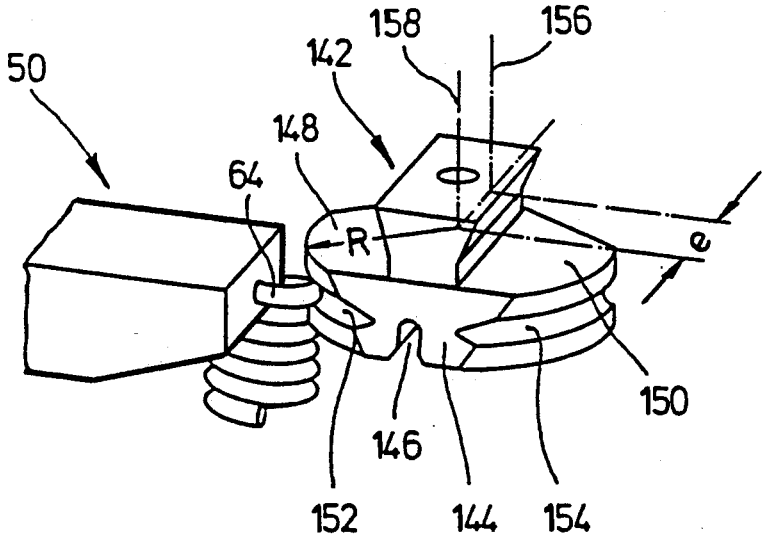
FIG. 6 shows a combined bending and winding tool (in perspective) of the first embodiment.

A tool (142) shown in FIG. 6. which may be inserted in the prism guide (120) of the tool holder (74) instead of the bending tool (86),is more universal in construction. In this tool (142). its inclined surface (144) corresponds to the surface (128) and a groove (146) corresponds to the operating groove (124) of the tool (86) of FIGS. 1 and 3. It may be used for similar operations (bending operations).

Adjoining the surface (144) are disc segments (148,150), one on each side, each with a groove (152, 154). When the disc segment (148) is brought into the operative position in front of the wire guide (50) by rotation of the winding spindle (12), the wire (64) moving into contact with it is formed into a downwardly directed spring body with lefthand turn. When, on the other hand, the disc segment (150) is in operation, a downwardly spiralling spring body with righthand turn is formed.

Since the axis of rotation (156) of the winding spindle (12) and the generating axis (158) of the disc segments (148, 150) are spaced apart by the distance (e), the diameters of the spring bodies may be varied within the range of operation of the two disc segments by an amount depending on the angle through which the winding spindle (12) had been turned in order to bring the disc segments into the operative position. The larger the angle of rotation of the winding spindle, the smaller will be the diameter of the spring body.

Second Embodiment

Figure 11:
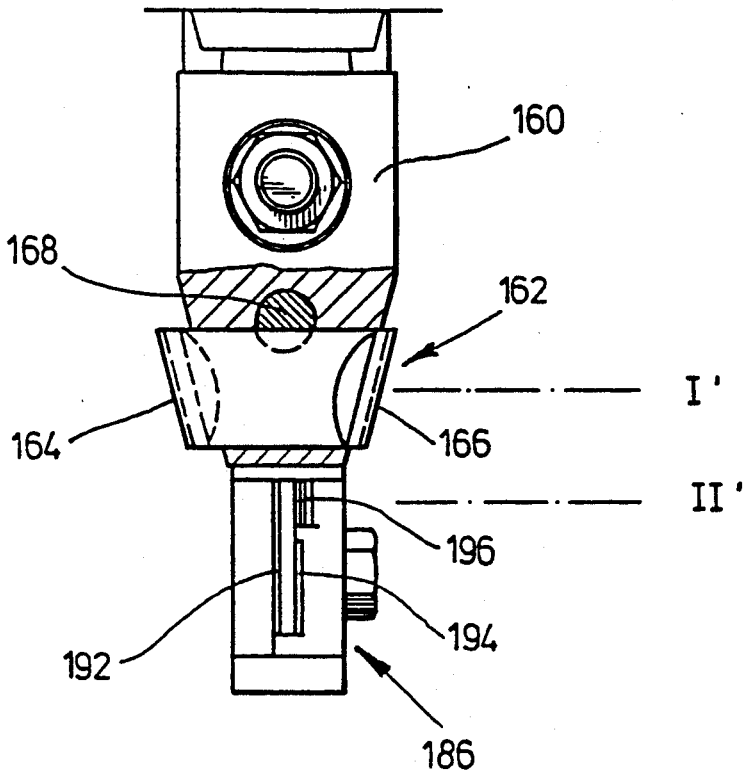
FIG. 11 is a side view of a section of FIG. 9.
Figure 9:
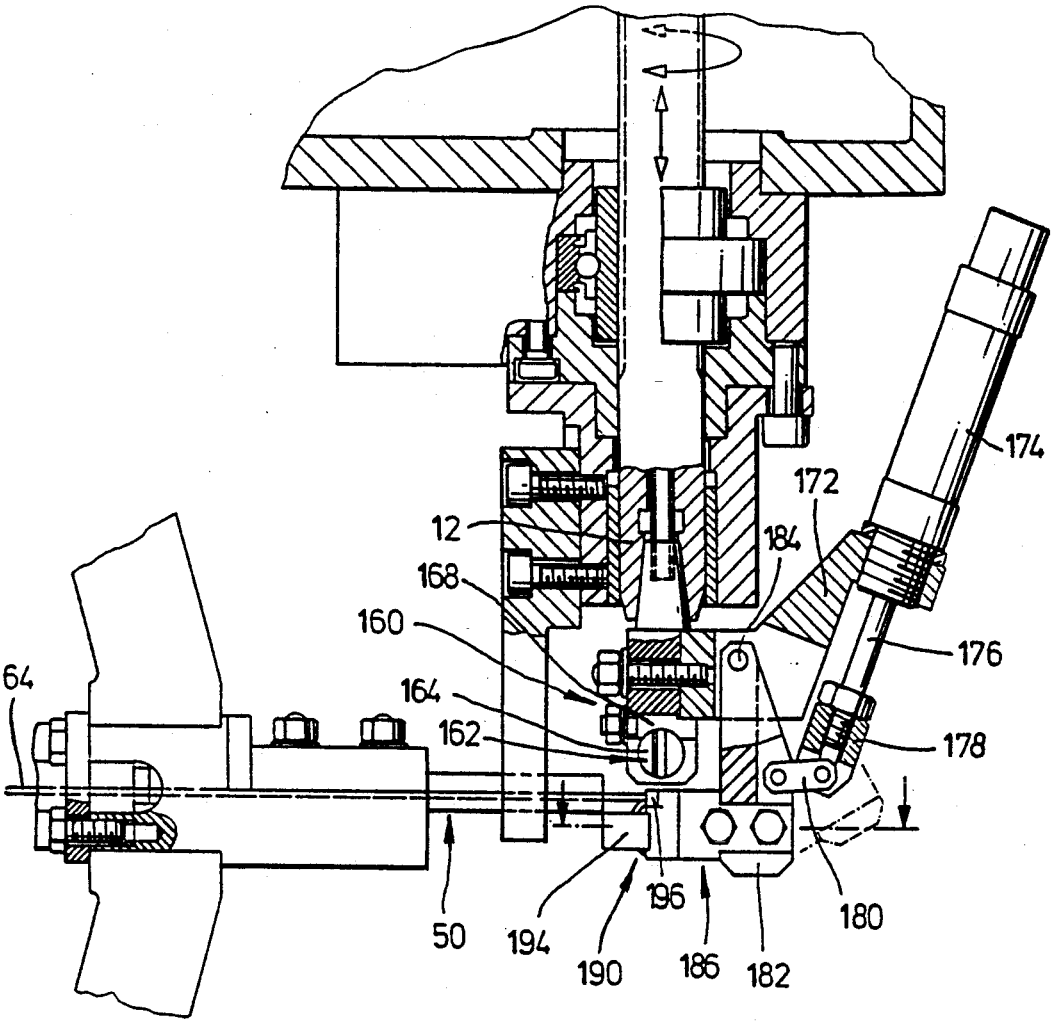
FIG. 9 is an illustration of a second embodiment corresponding to FIG. 1.

The tool holder (160) shown in FIGS. 9 and 11 carries a winding tool (162) situated in plane (I') and having operating zones (!64, 166) cut into it on both sides, zone (164) being used for the production of a region of relatively small winding diameter and zone (166) for larger diameters, in each case after the operating zone has been moved into position in front of the wire guide (50) by rotation of the winding spindle (12) through 180°. In addition, this tool holder (160) carries an attachment for the formation of eyelets operating in another plane (II'),as shown on the righthand side of FIG. 9 and described below.

The tool (162) is fixed in the tool holder (160) by a clamping bolt (168).

Figure 12:
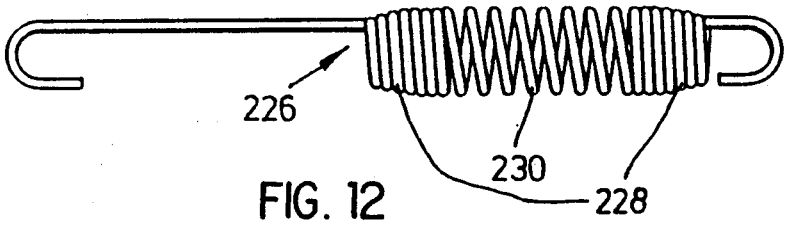
FIG. 12 shows a wire workpiece produced by means of the second embodiment.

The tool holder (160) does not require a recess cut out of it for producing the spring with eyelet shanks shown in FIG. 12 since there are no rotating spring parts in this case which would cause an obstruction.

A single acting compressed air cylinder (174) provided with a piston rod (176) with forked piston head (178) and a return spring (for the extended piston rod) is screwed into a support (172) fixed laterally to the tool holder (160). The forked head (178) is connected by a movable fishplate (180) to a rocking lever (182) which is pivoted to the support (172) by a pin (184). A head (186) carrying eyelet forming tools (190) is screwed to the rocking lever (182). These eyelet forming tools (190) comprise a tool (192) whose front edge is partly formed by a cutting blade and is used for separating and bending the turns of the coil, a guide plate (194) for guiding the spring body, and a bending edge (196) formed on the head (186) for bending the wire to form the eyelets.

Figure 10:
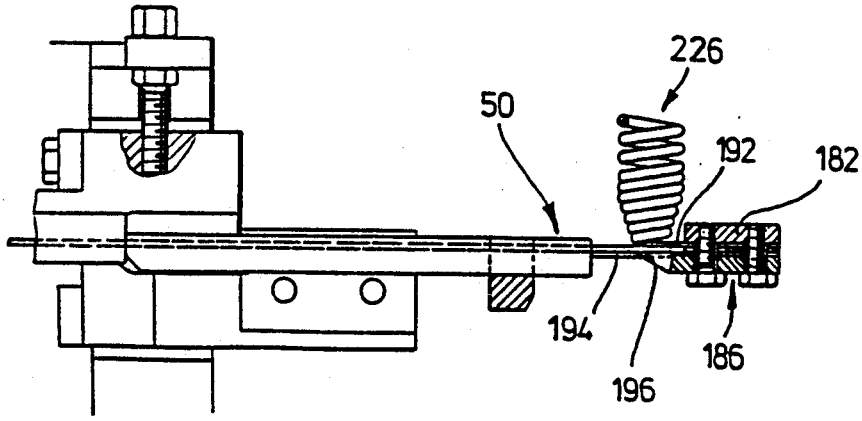
FIG. 10 is a top plan view of the second embodiment.

The production of a spring with eyelet shanks (226) shown in FIGS. 10 and 12, having a biconical spring body part (228) with sections of varying winding pitches (230) as shown in FIG. 12 is carried out as illustrated in FIG. 13, a to q.

Figure 13A:
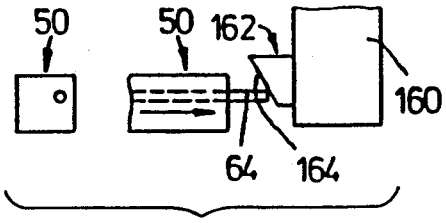
FIG. 13 shows the stages of manufacture of the workpiece of FIG. 12 each part (a to q) of the FIG. showing, on the righthand side, a front view of the wire guide provided in the second embodiment and the tools employed and, on the lefthand side, a side view of the wire guide: corresponding to FIG. 8.
Figure 13B:
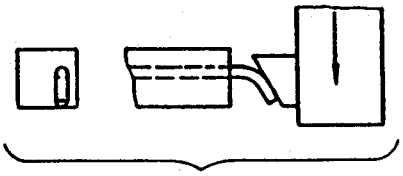
Figure 13C:
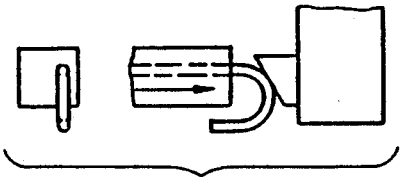
Figure 13D:
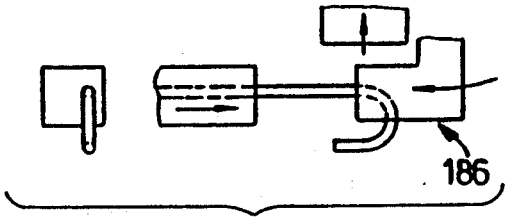
Figure 13E:
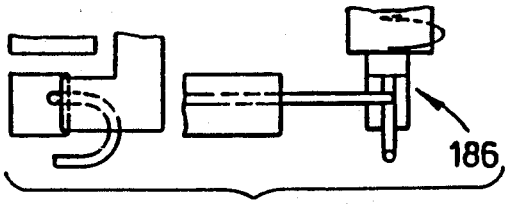
Figure 13F:
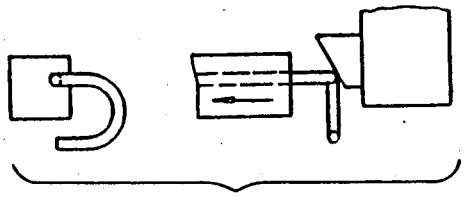

The winding spindle (12) is rotated clockwise through 90° from the position shown in FIG. 9 and moved downwards so that the wire (64) passing forwards through the guide (50) encounters the downwardly directed, oblique operating zone (164) of the winding tool (162) which is now in position in the holder (160) (FIG. 13*a*). The winding spindle then moves slightly further downwards without any further supply of wire until the winding tool reaches the position for the winding process (plane I'), whereby the wire is deflected downwards (FIG. 13*b*). A half turn is then formed when the supply of wire is resumed (FIG. 13*c*). While the supply of wire is stopped, the winding spindle moves anticlockwise through 90°. Compressed air is then supplied to the cylinder (174), whereby the head (186) carrying the eyelet forming tools (190) is swung into the operative position by the rocking lever (182) which is moved from the position shown in dash-dot lines in FIG. 9 into the position shown in solid lines in that figure. At the same time, the winding spindle is moved upwards until the eyelet forming tools are in their eyelet forming position (FIG. 9). Wire is now again pushed forwards until the previously formed half turn and the short, straight shank are in the eyelet forming position between the tool (192) and the bending tool (196) (FIG. 13*b*). The supply of wire stops, the winding spindle is rotated anticlockwise through 90° and the eyelet is formed by bending the end of the wire over the bending edge of the tool (192) (FIG. 13*e*). The air from cylinder (174) is then expelled through a control valve so that the piston rod (176) is withdrawn by the force of the return spring and the eyelet forming tools are moved outwards. The winding spindle rotates clockwise through 180°. At the same time, the wire (64) with the beginnings of the eyelet already formed on it is drawn back until contact is made with the winding tool (162) (FIG. 13*f*) after the winding spindle has been moved downwards to the position shown in FIG. 13*a*.

Figure 13G:
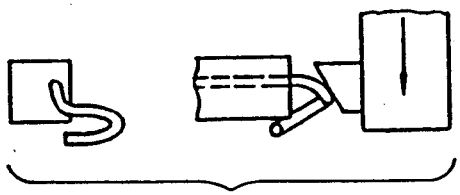

The spindle then moves slightly further down into the winding position, thereby causing the wire to be slightly bent (FIG. 13*g*).

Figure 13H:
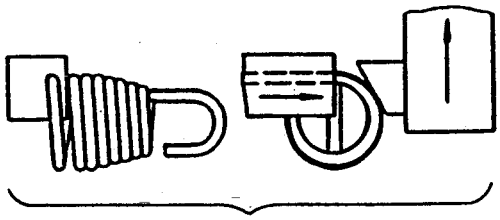
Figure 13I:
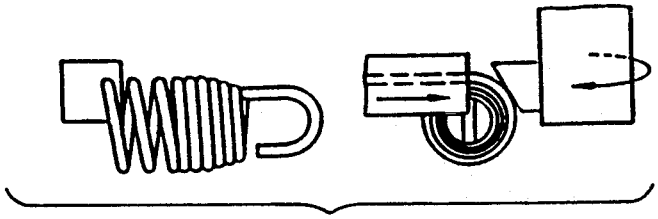
Figure 13J:
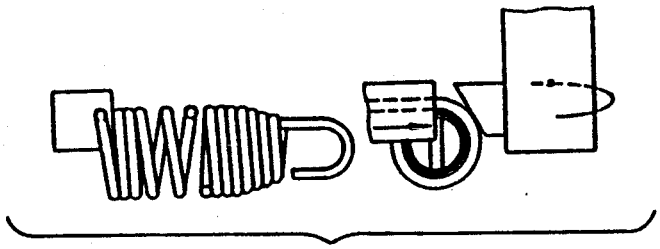
Figure 13K:
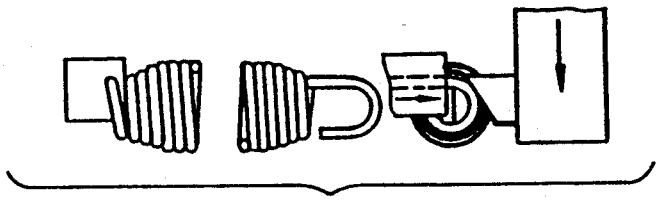
Figure 13L:
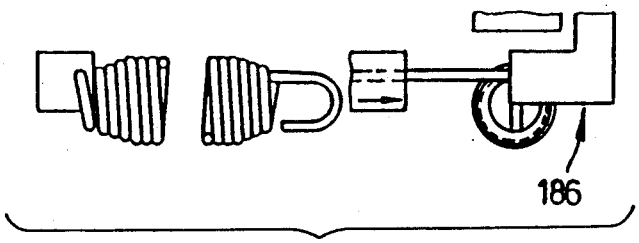
Figure 13M:
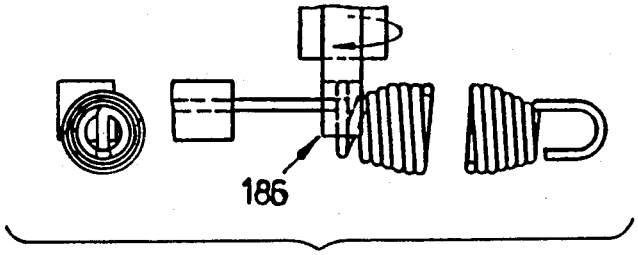
Figure 13N:
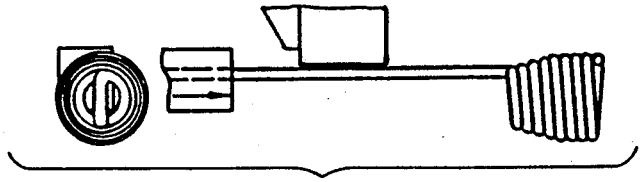
Figure 13O:
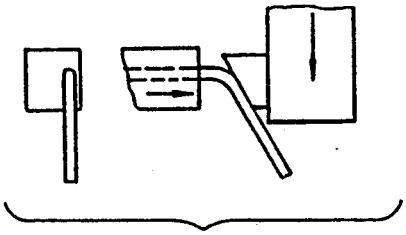
Figure 13P:
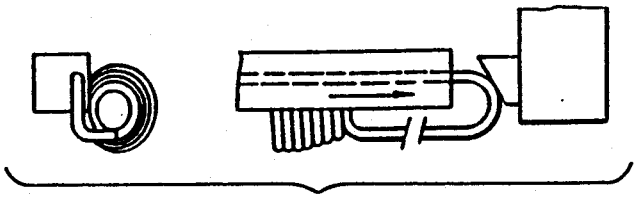
Figure 13Q:
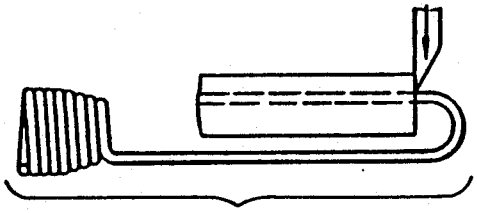

As the supply of wire is again resumed and the winding spindle moves slowly upwards, the conical part of the spring is formed, in which the turns of the wire are close together and progressively increase in diameter (the point at which the wire is deflected on the winding tool moves in an oblique line away from the wire guide) (FIG. 13*h*). For forming the spring section (230) with winding pitch, the winding spindle is moved forwards in the clockwise sense by an amount depending on the pitch, whereby the wire moving on to the winding tool is deflected downwards by the guide groove cut into the winding tool (this has been omitted for the sake of clarity from the schematically illustrated stages of the process) (FIG. 13*i*) and the winding spindle is then turned back by the same amount for the transition to the spring body part (FIG. 13*j*). For producing the next following tapering, conical part, the winding spindle again moves slowly downwards with the winding tool (FIG. 13*k*). The spindle then again turns anticlockwise through 90° and the eyelet forming tools are moved into the operative position as previously described (plane II'). Fresh wire is then supplied until the spring body, guided by the guide plate (194), has moved away from the wire guide (50) into the eyelet forming position and the tool (192) has inserted itself with its cutting blade between the two last formed windings until the bending edge (196) of the head (186) is in the bending position (FIG. 131). The supply of wire then again stops and the winding spindle is moved forwards clockwise through 90° and the bending operation is completed (FIG. 13*m*). The piston rod is then withdrawn as already described, so that the eyelet forming tools are separated from the spring body. The wire is then fed in to form the long spring shank (FIG. 13*n*). The winding spindle moves downwards so that the spring shank is bent downwards until it comes to lie in the groove of the winding tool (FIG. 13*o*) and a half turn is formed as the supply of wire continues (FIG. 13*p*). The completely formed spring with eyelet shanks 226 is then cut off from the wire supply by a knife at the wire guide (FIG. 13*q*).

All the movements are program controlled, as are also the movements by which the stages shown in parts a to o of FIG. 8 in the manufacture of the spring of FIG. 7 are obtained.

Although only preferred embodiments are specifically illustrated and described herein, it will be appreciated that many modifications and variations of the present invention are possible in light of the above teachings and within the purview of the appended claims without departing from the spirit and intended scope of the invention.

I claim:

1. Apparatus for the forming of wire, in particular a leg spring or spiral spacing winding and bending machine, comprising:

a wire guide, said wire guide having an inlet and an outlet, the wire moving along a pathway both inside and outside of said wire guide, a wire feed device located at the inlet of said wire guide, a shaft located at the outlet of said wire guide, said shaft having a free end, a longitudinal axis, and an axis of rotation located in close proximity to the pathway of the wire outside the wire guide, a plurality of tools for winding and bending the wire supplied thereto, said tools being movable in succession into the pathway of the wire, a tool holder to which said tools are fixed, said tool holder detachably attached to the free end of said shaft so as to be rotatable with said shaft and displaceable with said shaft in a direction parallel to the shaft longitudinal axis, means for rotating said shaft means for displacing said shaft, said means for rotation and means for displacement of said shaft adapted to be program controlled.

2. Apparatus according to claim 9, wherein the tools are mounted so as to be distributed over the circumference of the tool holder and over the length thereof.

3. Apparatus according to claim 2, further including a multiple bending tool which has two operating ones in each of two operating planes, each of said operating zones has two bending edges.

4. Apparatus according to claim 3, further comprising an additional attachment having eyelet forming tools and a pneumatic cylinder for positioning said tools, said additional attachment mounted on said tool holder.

5. Apparatus according to claim 2, further comprising an additional attachment having eyelet forming tools and a pneumatic cylinder for positioning said tools, said additional attachment mounted on said tool holder.

6. Apparatus according to claim 1, further including a multiple bending tool which has two operating zones in each of two operating planes, each of said operating zones has two bending edges.

7. Apparatus according to claim 6, further comprising an additional attachment having eyelet forming tools and a pneumatic cylinder for positioning said tools, said additional attachment mounted on said tool holder.

8. Apparatus according to claim 1, wherein the tool holder carries an additional attachment having eyelet forming tools and a pneumatic cylinder positioning said eyelet forming tools.

* * * * *